US008381632B1

(12) United States Patent
Chu et al.

(10) Patent No.: US 8,381,632 B1
(45) Date of Patent: Feb. 26, 2013

(54) LIGHTWEIGHT ARMOR SYSTEM

(75) Inventors: Henry S. Chu, Idaho Falls, ID (US); Benjamin R. Langhorst, Idaho Falls, ID (US); Michael P. Bakas, Ammon, ID (US); Gary L. Thinnes, Idaho Falls, ID (US)

(73) Assignee: The United States of America as represented by the Department of Energy, Washington, DC (US)

( * ) Notice: Subject to any disclaimer, the term of this patent is extended or adjusted under 35 U.S.C. 154(b) by 215 days.

(21) Appl. No.: 13/022,065

(22) Filed: Feb. 7, 2011

(51) Int. Cl.
*F41H 5/08* (2006.01)

(52) U.S. Cl. ..... 89/36.05; 89/36.02; 2/2.5

(58) Field of Classification Search ..... 89/36.01, 89/36.02, 36.05, 36.07; 2/2.5, 6.8
See application file for complete search history.

(56) References Cited

U.S. PATENT DOCUMENTS 5,885,912 A * 3/1999 Bumbarger ..... 442/239
6,371,977 B1 * 4/2002 Bumbarger et al. ..... 607/108
6,698,510 B2 * 3/2004 Serra et al. ..... 165/185
7,861,637 B2 * 1/2011 Leivesley ..... 89/36.02
2008/0250916 A1 * 10/2008 Bailey ..... 89/36.02
2008/0282876 A1 * 11/2008 Leivesley et al. ..... 89/36.02
2011/0174144 A1 * 7/2011 Kuchinsky et al. ..... 89/36.02

OTHER PUBLICATIONS

Luo et al, "Experimental Study and Property Analysis of Seal-filling Hydrogel Material for Hermetic Wall in Coal Mine," Journal of Wuhan University of Technology—Mater. Sci. Ed. 25 (2010).
Yang et al., "Dynamic compressive properties and failure mechanism of glass fiber reinforced silica hydrogel," Material Science and Engineering A 527 (2010).

* cited by examiner

*Primary Examiner* — Benjamin P Lee
(74) *Attorney, Agent, or Firm* — James B. Potts; Mark P. Dvorscak; John T. Lucas

(57) ABSTRACT

The disclosure provides a shock absorbing layer comprised of one or more shock absorbing cells, where a shock absorbing cell is comprised of a cell interior volume containing a plurality of hydrogel particles and a free volume, and where the cell interior volume is surrounded by a containing layer. The containing layer has a permeability such that the hydrogel particles when swollen remain at least partially within the cell interior volume when subjected to a design shock pressure wave, allowing for force relaxation through hydrogel compression response. Additionally, the permeability allows for the flow of exuded free water, further dissipating wave energy. In an embodiment, a plurality of shock absorbing cells is combined with a penetration resistant material to mitigate the transmitted shock wave generated by an elastic precursor wave in the penetration resistant material.

20 Claims, 6 Drawing Sheets

PRIOR ART

LIGHTWEIGHT ARMOR SYSTEM

GOVERNMENT INTERESTS

The United States Government has rights in this invention pursuant to Contract No. DE-AC07-05ID14517, between the U.S. Department of Energy (DOE) and Battelle Energy Alliance, LLC.

FIELD OF THE INVENTION

One or more embodiments relates to a shock absorbing layer comprised of a hydrogel. In operation, the hydrogel is a plurality of swollen hydrogel particles. The swollen hydrogel particles act in combination with a porous containing layer and a free volume to dissipate transmitted shock wave energy through frictional flow losses between the free water and the polymer network and the free water and the porous containing layer.

BACKGROUND

Impact processes are encountered when bodies are subjected to rapid impulsive loading, where the duration of application is short compared to the time for the body to respond inertially. The inertial responses are stress pulses propagating through the body to communicate the presence of loads to interior points. Commonly, such loadings are the result of ballistic impact or explosion.

Armors for the protection of personnel and equipment against impact processes are an area of significant effort. Armors are often multi-layer protective systems, with distinct protective characteristics arising as a result of individual material characteristics and resulting interfaces. In a typical armor system, the kinetic energy of an incoming projectile or blast wave is dissipated through deformation or destruction of a front plate with backing plates providing for subsequent dissipation of kinetic energy that may transfer from or pass through the front plate without absorption. Typically, if an impact drives a material beyond its elastic strength, then an elastic wave behaving as a shock wave propagates away from the impact zone with an amplitude determined by the largest elastic stress that can be supported by the medium. Behind this wave there propagates a generally irreversible deformation wave that carries the material to the ultimate stress state that exists on the impact plane. The energy of the elastic precursor wave is generally much less than the subsequent deformation wave, however when transmitted and coupled to a human body, the elastic precursor wave can result in significant trauma.

As an armor component, hydrogels have been investigated as energy absorbing components. Hydrogels have been utilized in various armors and blast protections both as primary absorption mechanisms and as backing layers. Hydrogels generally are cross-linked polymer networks having hydrophilic properties. When immersed in water, water diffuses into the hydrogel network due to osmotic pressure differences. The extent of diffusion is limited by the elastic stress caused by the stretching polymer chains and by any other stresses that act on the polymer phase. The network is comprised of large macromolecular chains and the solvent phases is of low molecular weight, so that the liquid phase when unconstrained can be highly mobile compared to the network. In a constrained state, where both the polymer and the liquid are enclosed by a contacting boundary, the polymer network and the solvent phase tend to act in conjunction as an incompressible fluid.

In some applications, the tendency to incompressibility has been exploited for pressure wave absorption by constraining a swollen hydrogel within a porous layer, and relying on frictional flow between the hydrogel and the porous layer in order to dissipate compression energy. See e.g., U.S. Pat. No. 5,885,912 to Bumbarger, issued Mar. 23, 1999. These systems act to confine the hydrogel within a porous surrounding layer until the porous surrounding layer becomes subject to significant deformation by, for example, the arrival of a deformation wave at the back-side of an armor fronting plate. The deformation of the porous surrounding layer fractures the confined hydrogel and produces a flow of the fractured hydrogel through the pores of the surrounding layer. The fracture energy and the frictional flow of the highly viscous hydrogel through the pores dissipate some portion of the energy delivered by the arrival of the deformation wave, however the energy of the preceding elastic precursor wave, which produces insignificant deformation, largely passes through the confined hydrogel without attenuation. In the case of a personal armor system, this energy is coupled to the body of the wearer. In a similar application, confined hydrogels are utilized for isolation of blasts arising from spontaneous gas explosions in a mining environment. See Luo et al, "Experimental Study and Property Analysis of Seal-filling Hydrogel Material for Hermetic Wall in Coal Mine," *Journal of Wuhan University of Technology-Mater. Sci. Ed.* 25 (2010). In the latter application, the swollen hydrogel acts to absorb blast energy through elastic deformation of the polymer network. This mechanism can marginally operate in the absence of a deformation wave solely through elastic stretching, however the confined nature of the swollen hydrogel maintains a constant percentage of free water in the hydrogel, and eliminates any subsequent dissipation through the frictional flow of exuded free water.

It is known that swollen hydrogel particles under an unbounded compression undergo a viscoelastic deformation which acts to drive at least some free water from the swollen hydrogel polymer network. High-speed compressions indicate that the viscoelastic nature and frictional flow between the free water and the polymer network can produce significant force relaxation. See e.g., Wang et al., "High-speed compression of single alginate microspheres", *Chemical Engineering Science* 60 (2005). Significant yielding and deformations up to 50% may occur prior to failure of the swollen hydrogel particle. Generally speaking, the friction coefficient of the swollen polymer network and the free water is proportional to the ratio of the viscosity of the free water and the average mesh size of the gel. For permanently cross-linked polymer networks, the friction can be enormous because the polymer network is a mesh of molecular size. See e.g., Doi et al., "Friction Coefficient and Structural Transition in a Poly(acrylamide) Gel", *Langmuir* 21 (2005). As a result, if a swollen hydrogel could be arranged such that frictional flow between free water and the hydrogel network was allowed in an unconstrained flow environment, these frictional losses could be utilized for effective absorption of a shock pressure, such as that arising from a transmitted shock wave. Further, if the exuded free water were allowed to accrue additional energy absorption through subsequent frictional flow, shock pressures could be further mitigated.

Accordingly, it is an object of this disclosure to provide a shock absorbing layer utilizing a swollen hydrogel in a manner that more effectively mitigates shock wave compression energy, so that the coupling of a shock wave compression to the body of the wearer is further reduced.

Further, it is an object of this disclosure to provide a shock absorbing layer utilizing a swollen hydrogel in a manner allowing absorption of shock pressures through frictional flow between free water and the hydrogel network.

Further, it is an object of this disclosure to provide a shock absorbing layer utilizing a swollen hydrogel in a manner that provides for additional energy absorption through subsequent frictional flow of free water exuded as a result of shock pressure.

Further, it is an object of this disclosure to provide a shock absorbing layer incorporating a plurality of contained hydrogel volumes, so that exuded free water may act to disperse shock pressure energy in directions substantially dissimilar to the prevailing shock pressure wave.

Further, it is an object of this disclosure to provide a shock absorbing layer incorporating a plurality of contained hydrogel volumes in mechanical communication and having increasing free volume percentages as displacement from the shock pressure source increases, in order to accommodate flow of exuded free water and increase frictional flow losses.

Further, it an object of this disclosure to provide a shock absorbing layer incorporating a flexible cooling layer comprised of one or more cooling channels in fluid communication with an ambient environment, so that cooling may be provided to a wearer in a high temperature environment.

These and other objects, aspects, and advantages of the present disclosure will become better understood with reference to the accompanying description and claims.

SUMMARY

The process as disclosed herein provides a shock absorbing layer for the mitigation of an impinging shock wave from a shock wave source. For example, the mitigation of a shock wave generated in the blast wave of an explosive blast, or a shock wave generated as a result of an elastic precursor wave following the impact of a ballistic projectile on hard surface ballistic armors, among others.

The shock absorbing layer is comprised of one or more shock absorbing cells. The shock absorbing cells are individually comprised of a containing layer enclosing a plurality of absorbent hydrogel particles. The cell interior volume formed within the enclosing containing layer is such that when the plurality of hydrogel particles are swollen, the cell interior volume accommodates the hydrogel particles while concurrently allowing for establishment of a free volume. The permeability of the containing layer is such that at least a portion of the plurality of hydrogel particles are contained within the cell interior volume when swollen and subjected to a design shock pressure wave. Further, the permeability is such that when a volume of water is adjacent to the containing layer and the volume of water is subjected to the design shock pressure wave, at least some portion of the volume of water flows through the containing layer.

The compression response, adhesion, viscosity, and other characteristics of the hydrogel particles, in combination with the permeability of the containing layer act to mitigate the energy of an impinging short duration pressure wave. During the short duration pressure wave, the swollen hydrogel particles are at least partially retarded from flowing through the containing layer and the compressive force acts to viscoelastically deform the swollen hydrogel particles, driving at least some free water from the swollen hydrogel polymer network. The viscoelastic nature and frictional flow between the free water and the polymer network produces significant force relaxation and greatly attenuates the short duration pressure wave as it passes through the swollen hydrogel particles. The expelled free water flows into the free volume and provides further dissipation as the expelled free water is driven through the containing layer. The expelled free water may be forced through the containing layer in a multitude of directions substantially dissimilar to the prevailing direction of the short duration pressure wave, providing significant lateral dispersion.

The novel process and principles of operation are further discussed in the following description.

DETAILED DESCRIPTION

Figure 1:
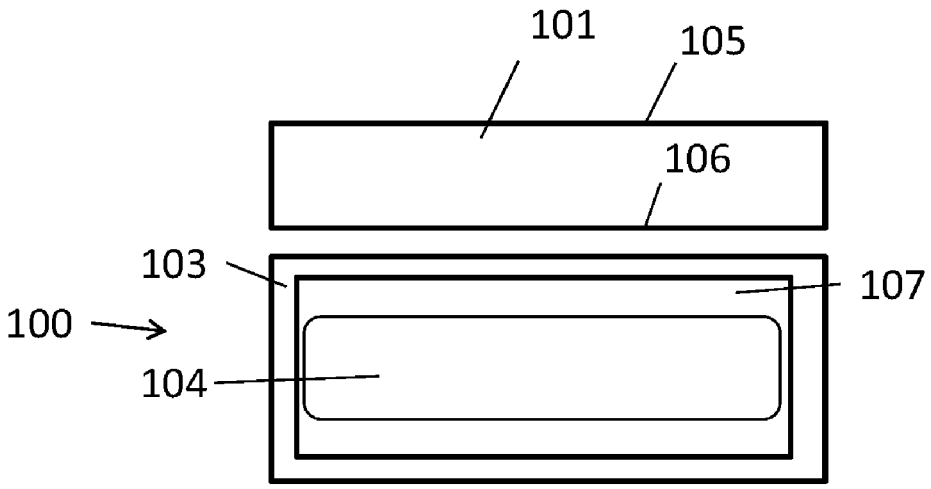
FIG. 1 illustrates an embodiment of a shock absorbing layer comprised of a shock absorbing cell.

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a shock absorbing layer comprised of one or more shock absorbing cells, where a shock absorbing cell is comprised of a cell interior volume containing a plurality of hydrogel particles and a free volume, and where the cell interior volume is surrounded by a containing layer having a specified permeability.

The disclosure herein provides a shock absorbing layer for the mitigation of an impinging shock wave from a shock wave source. For example, the mitigation of a shock wave generated in the blast wave of an explosive blast, or a shock wave generated as a result of an elastic precursor wave following the impact of a ballistic projectile on hard surface ballistic armors, among others.

The shock absorbing layer is comprised of one or more shock absorbing cells. The shock absorbing cells are individually comprised of a containing layer enclosing a plurality of absorbent hydrogel particles. The cell interior volume formed within the enclosing containing layer is such that when the plurality of hydrogel particles are swollen, the cell interior volume accommodates the hydrogel particles while concurrently allowing for establishment of a free volume. The free volume within each shock absorbing cell is devoid of swollen hydrogel particles or other solid or liquid matter.

The free volume is a significant characteristic of the shock absorbing layer. Swollen hydrogels are biphasic materials and in the absence of a free volume, tend to react as incompressible substances in response to short-duration shock pressures, such as would be experienced from a shock wave generated by an explosive blast or an elastic precursor wave following ballistic impact on a material. In the absence of a free volume, and as a result of the subsequent incompressible behavior, a shock pressure would largely pass through the constrained, swollen hydrogel material without significant dissipation or mitigation, and be subsequently experienced within the environment a swollen hydrogel layer is intended to protect. For example, as a component in a personal armor system, a layer of swollen hydrogel without the presence of a free volume allows an initial shock wave from an elastic precursor wave or an initial blast pressure to pass through the swollen hydrogel and be experienced by the wearer, often resulting in significant physical trauma. By contrast, the free volume within the shock absorbing layer of this disclosure provides for shock wave dissipation through the compression response of the swollen hydrogel particles. During the compression response, frictional flow of free water exuding from the swollen hydrogel initially dissipates and spreads the energy of the impinging shock wave, and subsequent flow of the exuded free water through the containing layer further mitigates the shock wave energy. Neither of these responses is available in a system utilizing swollen hydrogel particles in the absence of a free volume.

Within this disclosure, the term "cell interior volume" as used with reference to the shock absorbing cell described herein means a three-dimensional volume formed by a surrounding containing layer, such that the cell interior volume is a closed volume having the containing layer as a contiguous boundary. Gaseous, liquid, or solid matter may reside within a cell interior volume as defined herein.

Within this disclosure, the term "free volume" means a three dimensional volume within a cell interior volume when swollen hydrogel particles reside within the cell interior volume, where the free volume is that portion of the cell interior volume characterized by the absence of swollen hydrogel particles or other solid or liquid matter, and where the free volume has a gaseous pressure equivalent to the ambient pressure existing outside of the shock absorbing cell, when the shock absorbing cell is not experiencing a shock pressure wave. Further the term "free volume percentage" as used in this disclosure means the percentage of a cell interior volume comprised by a free volume, when swollen hydrogel particles reside within the cell interior volume, and when the free volume has a gaseous pressure equivalent to the ambient pressure existing outside of the shock absorbing cell.

Within this disclosure, the term "hydrogel" means a cross-linked polymer network having hydrophilic properties. Further, within this disclosure, the term "swollen" when used in conjunction with a hydrogel denotes a hydrogel comprised of some degree of free water. As is understood, hydrogels are highly water absorbent natural or synthetic polymers. As in known in the art, the water present in a hydrogel may be broadly classified as bound water, intermediate water, and free water. Bound water and intermediate water are water molecules bound to the polymer molecules through hydrogen bonding or some other means, and are largely immobilized. The extent of bound and intermediate water in a hydrogel may be determined by various methodologies, such as dehydration and freezing. The water known as free water are water molecules that do not take part in hydrogen bonding with polymer molecules, and as a result have a much greater degree of mobility in comparison with bound or intermediate water molecules. Thus, a "swollen hydrogel" or like terms as used in this disclosure denotes a hydrogel comprised of some degree of free water.

Within this disclosure, the term "transmitted shock wave" means a region of high pressure propagating through a medium at a velocity at least equivalent to the local speed of sound and characterized by an abrupt, nearly discontinuous change in the characteristics of the medium. As is understood, when a transmitted shock wave impinges on a solid material, the impingement gives rise to a shock pressure felt on the solid material.

Within this disclosure, the term "design shock pressure wave" means a shock pressure wave having a defined magnitude and duration and experienced by swollen hydrogel particulates in a shock absorbing cell, as a result of a transmitted shock wave impinging on the shock absorbing cell. As is understood, the magnitude and duration of the design shock pressure wave may be a function of the maximum ballistic or blast threat that a system utilizing the shock absorbing layer described here is designed to defeat.

An embodiment of the shock absorbing layer disclosed herein is discussed with reference to FIG. 1. FIG. 1 illustrates a shock absorbing cell 100 comprising a shock absorbing layer. Shock absorbing cell 100 is comprised of containing layer 103 surrounding and forming a cell interior volume, and is further comprised of a hydrogel 104 within the cell interior volume. The cell interior volume formed by containing layer 103 exceeds the volume of hydrogel 104 when hydrogel 104 is swollen, such that a free volume 107 exists within the cell interior volume. Further, the permeability of the containing layer 103 is such that at least a portion of hydrogel 104 is contained within the cell interior volume when hydrogel 104 is swollen and subjected to a design shock pressure wave, as will be further discussed infra. Typically, containing layer 103 is a flexible textile.

At FIG. 1, hydrogel 104 is comprised of a hydrogel material in particulate form. The term "particulate" is used herein to mean that the hydrogel material is in the form of discrete units denominated "particles". The particles can comprise granules, pulverulents, spheres, aggregates or agglomerates. However, typically, the particles described herein will be largely non-aggregated. The particles can have any desired shape such as cubic; polyhedral; spherical; rounded; angular; irregular; or randomly-sized irregular shapes.

By weight, a swollen hydrogel is mostly liquid but behaves like a solid due to a three-dimensional cross-linked network within the liquid. Generally speaking, the crosslinks within the fluid give a swollen hydrogel its structure, and contributes to stickiness or tack. In this way gels are a dispersion of molecules or particles within a liquid in which the solid is the continuous phase and the liquid is the discontinuous phase. Hydrogels are described, for example, in U.S. Pat. Nos. 4,057,521, 4,062,817, 4,525,527, 4,286,082, 4,340,706 and 4,295,987, among others.

As described, containing layer 103 surrounds the cell interior volume and contains hydrogel 104. Containing layer 103 is typically a flexible material able to deform under the normal action of, for example, a wearer in a working environment. Further and as mentioned previously, the cell interior volume enclosed by containing layer 103 is sufficient such when hydrogel 104 is swollen, a free volume 107 exists between the containing layer and hydrogel 104. The presence of free volume 107 when hydrogel 104 is in a swollen state is significant to the intended operation of shock absorbing cell 100, as will be discussed infra.

Further, containing layer 103 is permeable to air and water. Additionally, and significantly, containing layer 103 has a permeability such that at least a portion of hydrogel 104 does not permeate through containing layer 103 when hydrogel 104 experiences a design shock pressure wave. As will be discussed, a prevailing mode of energy dissipation in the shock absorbing layer disclosed here relies on frictional flow losses as free water is compressed from the polymer network of a given swollen hydrogel particle. Such compression on the swollen hydrogel particle may be significantly mitigated or eliminated if the particle is allowed substantially unrestrained acceleration and movement in the direction of an impinging design shock pressure wave. The shock absorbing layer disclosed herein is intended to provide for energy loss through frictional flow losses by employing a containing layer having a permeability such that at least some portion of the swollen hydrogel particles undergo a compression sufficient to force free water flow, as a result of pressure wave impingement and subsequent flow retardation arising through the material permeability and the viscoelastic effects of the hydrogel. Generally speaking, the permeability of the containing layer should be such that transfer of swollen hydrogel particles through the containing layer is minimized under a design shock pressure wave. Preferably, the permeability of the containing layer is such that a majority of the swollen hydrogel particles fail to transfer through the containing layer in response to the design shock pressure wave. More preferably, 90% or greater fail to transfer.

The term "permeability" as used herein means a measure of the ability of a porous material such as a containing layer to transmit a fluid. Permeability relates flow rate and fluid physical properties such as viscosity to a pressure gradient applied to the porous material. Permeability in this sense describes a material property of the porous material itself, such that for a given permeability and pressure gradient, flow rate would be expected to decrease with increasing viscosity of the fluid.

As discussed, the design shock pressure wave has a defined magnitude and duration, and may be a function of the ballistic or blast threat that a system utilizing the shock absorbing cell is designed to defeat. The shock absorbing cell described within this disclosure is not limited by the magnitude or duration of the design shock pressure wave, provided that the containing layer 103 has a permeability such that at least a portion, preferably a majority, more preferably greater than 90%, of swollen hydrogel particulates do not permeate through the containing layer when the swollen hydrogel particles experience the design shock pressure wave.

Figure 2A:
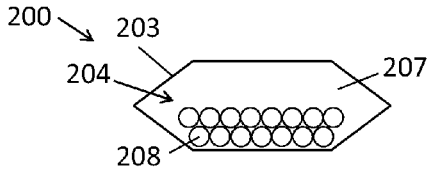
FIG. 2A illustrates a shock absorbing cell prior in the absence of a short duration compressive load.

The presence of free volume 107 when hydrogel 104 is in a swollen state is significant to the intended operation of shock absorbing cell 100. The free volume within the cell interior volume accommodates the response of the swollen hydrogel particles when subjected to a rapid compression arising from a shock pressure wave. This is illustrated with reference to FIG. 2A, showing shock absorbing cell 200 comprised of containing layer 203 surrounding hydrogel 204. Hydrogel 204 is comprised of a plurality of swollen hydrogel particles, such as swollen hydrogel particle 208. The cell interior volume enclosed by containing layer 203 is sufficient such the plurality of swollen hydrogel particles are accommodated with free volume 207 existing between containing layer 203 and the plurality of swollen hydrogel particles. As discussed, when containing layer 203 is not subject to a compressive load, free volume 207 has a gaseous pressure equivalent to the ambient pressure existing outside the cell interior volume enclosed by containing layer 203, as a result of equilibrium arising from the air permeable nature of containing layer 203.

Figure 2B:
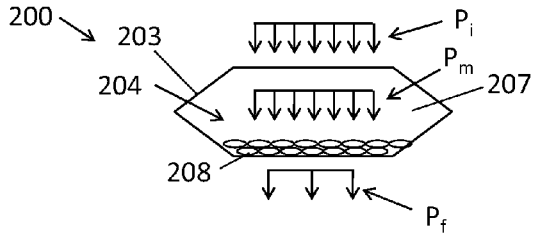
FIG. 2B illustrates a shock absorbing cell under the influence of a short duration compressive load.

The adhesion, viscosity, and other characteristics of hydrogel 204, in combination with the permeability of containing layer 203, act to mitigate the energy of an impinging short duration pressure wave. FIG. 2B illustrates shock absorbing cell 200 subjected to such a short duration pressure wave $P_i$. As a result of the short duration pressure wave $P_i$, containing layer 203 may deform somewhat and attenuate short duration pressure wave $P_i$ to some degree before some portion $P_m$ is felt on the plurality of swollen hydrogel particles, such as swollen hydrogel particle 208. As discussed previously, the permeability of containing layer 203 is such that some portion of the swollen hydrogel particles comprising hydrogel 204, preferably a majority, more preferably greater than 90%, are retarded from flowing through containing layer 203 during the short duration of pressure wave $P_m$. As a result, pressure wave $P_m$ acts to compress some portion of the swollen hydrogel particles. In terms of operation, pressure wave $P_m$ may be, for example, the design shock pressure wave.

It is known that swollen hydrogels may be characterized as biphasic materials. Biphasic mixture theory, also referred to as the poroelastic theory, characterizes the flow of fluid through a porous medium, which itself undergoes a deformation. The three dimensional polymer network and the penetrating fluid in a swollen hydrogel are taken as the solid and fluid phases respectively. In the swollen hydrogel, the network is comprised of large macromolecular chains and the solvent phases is of low molecular weight, so that the liquid phase is highly mobile compared to the network.

It is further known that swollen hydrogel particles under compressive load undergo a viscoelastic deformation which acts to drive at least some free water from the swollen hydrogel polymer network. High-speed compressions indicate that the viscoelastic nature and frictional flow between the free water and the polymer network can produce significant force relaxation. See e.g., Wang et al., "High-speed compression of single alginate microspheres", *Chemical Engineering Science* 60 (2005). Significant yielding and deformations up to 50% may occur prior to failure of the swollen hydrogel particle. Generally speaking, the friction coefficient of the swollen polymer network and the free water is proportional to the ratio of the viscosity of the free water and the average mesh size of the gel. For permanently cross-linked polymer networks, the friction can be enormous because the polymer network is a mesh of molecular size. See e.g., Doi et al., "Friction Coefficient and Structural Transition in a Poly(acrylamide) Gel", *Langmuir* 21 (2005).

As a result, at FIG. 2B, when the swollen hydrogel particles comprising hydrogel 204 are retarded from flowing through containing layer 203 during the short duration of pressure wave $P_m$, the compressive force acts to viscoelastically deform the swollen hydrogel particles and drive at least some free water from the swollen hydrogel polymer network. The viscoelastic nature and frictional flow between the free water and the polymer network produces significant force relaxation and greatly attenuates pressure wave $P_m$ as it passes through the swollen hydrogel particles. The expelled free water flows into free volume 207. As a result of the attenuation due to compression of the swollen hydrogel particles, frictional flow, and force relaxation effects, a significantly attenuated pressure wave $P_f$ results.

As discussed, the presence of free volume 207 is significant to this operation. In the absence of a free volume such as, for example, a situation where hydrogel is packed into a containing layer pocket such that the swollen hydrogel exhibits a positive pressure outward on the pocket, the short duration of a shock pressure wave combined with the lack of a free volume causes the swollen hydrogel to act as essentially an incompressible substance over the short duration of the shock pressure wave. As a result, force relaxation resulting from the frictional flow of free water expelled from the swollen hydrogel particles cannot occur, and the shock pressure wave passes through the containing layer pocket without significant attenuation. A similar situation arises when swollen hydrogels are surrounded by solid material substantially densified as result of the swelling pressure of the hydrogels. In these situations, energy dissipation which does occur results largely from deformation of the containing pocket itself driven by, for example, a deformation shock wave arriving at the back side of a bullet resistant outer layer, as opposed to the preceding elastic precursor wave.

The degree of force relaxation and subsequent pressure wave attenuation resulting from compression of the swollen hydrogel particles in the presence of free volume 207 is dependent on the free volume percentage as defined herein, among other factors. Preferably, the free volume percentage is at least 20%. More preferably, the free volume percentage is between 20% and 50%.

With reference to FIG. 1, and in order to provide for the operation illustrated at FIGS. 2A and 2B, an acceptable permeability of containing layer 103 may be determined based on the properties of hydrogel 104 and the design shock pressure wave acting on hydrogel 104. As is known, hydrogels in the swollen state generally exhibit adhesion and viscosity characteristics, among other properties. As is further understood, a shock pressure wave which acts on hydrogel 104 is an impulse-type pressure of extremely short duration. Within this disclosure, it is only necessary that the adhesion, viscosity, and other characteristics of hydrogel 104, in combination with the permeability of containing layer 103, function such that at least some portion of hydrogel 104 remains within the cell interior volume enclosed by containing layer 103 following the short duration of the design shock pressure wave. The acceptable permeability of containing layer 103 to meet this condition may be determined by computational modeling, prior experience, actual testing using, e.g. a high-speed compression, or other means. As discussed supra, it is preferable to minimize the transfer of swollen hydrogel particles through the containing layer in response to the design shock pressure wave. Further, it is not required that the permeability be sufficient to retard swollen hydrogel particle flow when subjected to a steady-state pressure equivalent to the maximum pressure of the design shock pressure wave, or any value of steady-state pressure, provided that the permeability is sufficient over the short duration of the design shock pressure wave.

In an embodiment, the plurality of hydrogel particles comprising hydrogel 104 are poly(acrylic acid) doped with partial sodium salt with a typical size of less than 150 micron in the unswollen state. Containing layer 103 is a flexible textile with a permeability deriving from pore sizes between ⅛ and 3/16 inches. The cell interior volume is sufficient to allow a free volume percentage of approximately 50% when the hydrogel particles are in a fully saturated swollen state.

Continued dissipation during the short duration of pressure wave $P_m$ occurs from the interaction of expelled free water and containing layer 203. At FIG. 2B, the expelled free water, having been forced into free volume 207 and having a significantly lower viscosity than the water-depleted hydrogel particles, may be forced through containing layer 203 by the continued action of pressure wave $P_m$. This provides for further dissipation as a result of frictional flow losses as the expelled free water passes through containing layer 203. This energy dissipation however significant necessarily occurs following force relaxation effects generated by expulsion of free water from the swollen hydrogel particles. Additionally, due to containing layer 203 surrounding hydrogel 204, the expelled free water may be forced through containing layer 203 in a multitude of directions substantially dissimilar to the prevailing direction of the pressure wave $P_m$. Flow through containing layer 203 in a multitude of directions dissimilar to $P_m$ may provide significant lateral dispersion of the pressure wave $P_m$, further attenuating the resulting pressure wave $P_f$.

In order to accommodate energy dissipation arising from the flow of expelled free water through containing layer 203, it is advantageous to further ensure that the permeability of containing layer 203 is sufficient such that flow stagnation is mitigated when $P_m$ acts on the expelled free water. For a given permeability of containing layer 203, it is expected that the significant viscosity difference between hydrogel 204 and the expelled free water will result in a significantly greater flow of expelled free water over the short duration of a pressure wave such as $P_m$, as compared to the flow of hydrogel 204 through containing layer 203, if any. This characteristic may serve as a bound on the acceptable permeability of containing layer 203 for optimal operation, in that the permeability should be sufficient such that some portion, preferably a majority, more preferably 90% or greater, of the swollen hydrogel particles fail to transfer through the containing layer in response to the design shock pressure wave, while concurrently the permeability should be sufficient such that stagnation of the expelled free water against containing layer 203 is mitigated when the expelled free water is subject to the design shock pressure wave.

Figure 3:
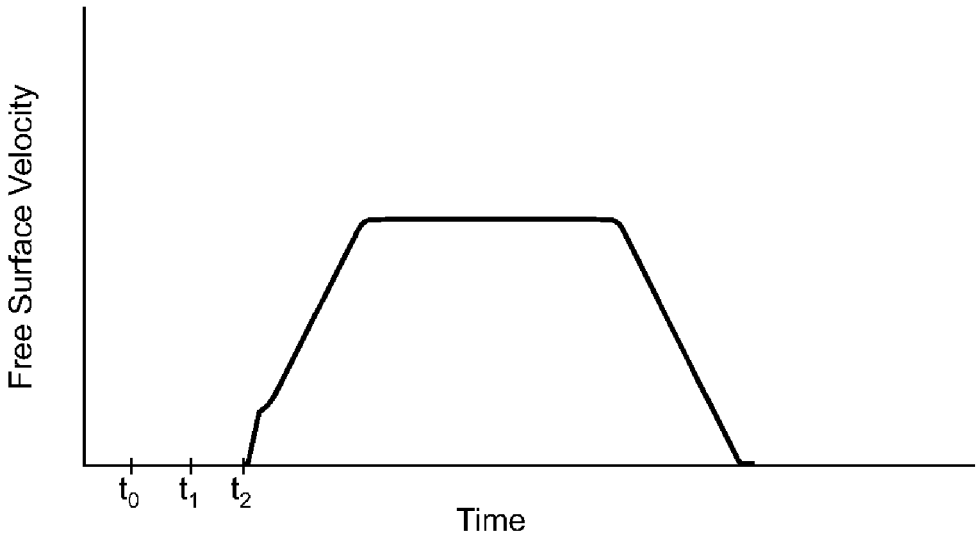
FIG. 3 illustrates the impact response of a penetration resistant material.

As discussed, a transmitted shock wave impinging on shock absorbing cell 100 and generating a short duration pressure wave such as $P_i$ may arise from any source. For example, at FIG. 1, shock absorbing cell 100 is intended to mitigate a transmitted shock wave emanating from back-face 106 of a penetration resistant outer layer 101 in response to a ballistic impact at strike-face 105. As is understood, materials experiencing a ballistic impact will first respond elastically when shock compressed before generating a propagating front of stable fracture. The elastic response generates an elastic precursor wave preceding a deformation wave that carries the material to the final shock compressed state. At the back-face of the material, the elastic precursor wave encounters an interface, and a transmitted shock wave and a reflected wave are generated. The transmitted shock wave, preceding the deformation wave in time, initially emanates from the back-face of the material without significant material deformation. This behavior can be observed, for example, through velocity interferometry of the backside following a ballistic impact, where the velocity history of the back surface directly reflects the structure of the shock waves that have propagated through the sample and the effects of shock compression on the material. Such observations indicate back-face displacement similar to that indicated generically at FIG. 3, where an impact occurs to a strike-face at time $t_0$, the elastic wave arrives at the back-face at time $t_1$, and elastic-to-plastic transition and subsequent back-face velocity occurs at a following time $t_2$. As is understood for ballistic impacts, these events occur on a time scale of microseconds. In the embodiment at FIG. 1, shock absorbing cell 100 is intended to mitigate the transmitted shock wave emanating from back-face 106 as a result of an elastic precursor wave propagating through penetration resistant outer layer 101 and arriving at back-face 106, in response to a ballistic impact at strike-face 105. However, as stated, within this disclosure a transmitted shock wave may arise from any source.

The term "penetration resistant" as it applies to penetration resistant outer layer 101 denotes a material or combination of materials which singularly or in combination are designed to dissipate all or some portion of the energy of an incoming blast or projectile. A penetration resistant material as used in this disclosure includes materials described as bullet resistant or blast resistant, bullet proof or blast proof, or other like terms. Such materials are designed to respond to an incoming ballistic threat at strike-face 105 by absorbing some portion of the kinetic energy of the incoming projectile through, for example, microfragmentation, fiber stretch, plastic deformation, or some other mechanism. Similarly, the term "strike-face" as applied to a penetration resistant material means an external face of the material oriented toward an impact source prior to impact. "Back-face" means an external face of the material other than the strike-face. In an embodiment intended for use with a penetration resistant material such as penetration resistant outer layer 101, the design shock pressure wave as defined herein may follow from the highest energy projectile for which bullet resistant outer layer 101 is designed to be bullet resistant, based on an applicable standard.

Further, as illustrated at FIG. 1, it is not necessary that back-face 106 establish physical contact with shock absorbing cell 100, provided that some medium such as air is present to result in transmission of the shock pressure wave to shock absorbing cell 100. As a result, physical contact between back-face 106 and shock absorbing cell 100 may or may not be present. With respect to the embodiment shown at FIG. 1, it is only necessary that penetration resistant outer layer 101 and shock absorbing cell 100 have relative positions such that a transmitted shock wave emanating from back-face 106 is transmitted to and experienced by shock absorbing cell 100. For example, when a ballistic impact occurs to strike-face 105 of bullet resistant outer layer 101, back-face 106 is expected to respond with a displacement profile similar to that indicated at FIG. 3, and a transmitted shock wave is expected to generate following the arrival of the elastic precursor wave and prior to deformation of back-face 106. The transmitted shock wave is expected to propagate through any medium between back-face 106 and shock absorbing cell 100 before impinging on shock absorbing cell 100. As is understood, the resulting shock pressure felt on shock absorbing cell 100 will depend on the properties of the interlaying medium, if any, between back-face 106 and shock absorbing cell 100.

In an embodiment such as that illustrated at FIG. 1, it is understood that additional effects are expected to occur following the arrival of a deformation wave at back-face 106, however the shock wave dissipating effects illustrated at FIGS. 2A and 2B temporally precede the arrival of a deformation wave at back-face 106, and are not reliant on any additional effects generated by arrival of the deformation wave at back-face 106.

Figure 4:
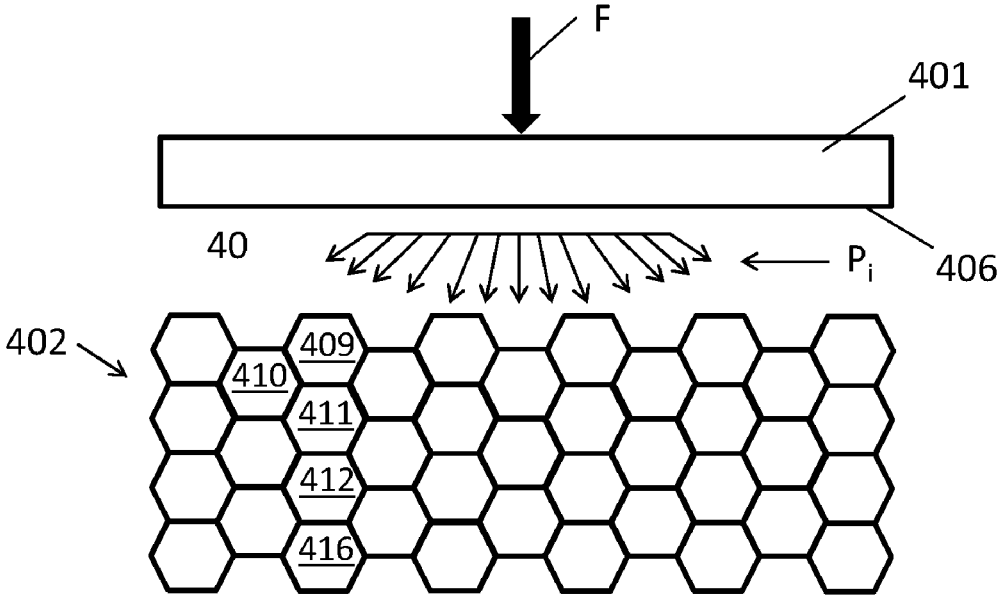
FIG. 4 illustrates a shock absorbing layer comprised of a plurality of shock absorbing cells.

In a further embodiment, a shock absorbing layer is comprised of a plurality of shock absorbing cells. For example, as depicted at FIG. 4, the plurality of shock absorbing cells generally indicated at 402 is comprised of shock absorbing cells 409, 410, 411, and 412, forming a honeycomb structure as illustrated. As previously described, each shock absorbing cell contains a plurality of hydrogel particles and possesses a free volume percentage. The plurality of shock absorbing cells 402 underlies penetration resistant outer layer 401, such that a transmitted shock wave emanating from back-face 406 impinges the plurality of shock absorbing cells 402.

It can be appreciated that in an arrangement such as depicted at FIG. 4, attenuation of a transmitted shock wave is enhanced as the shock wave proceeds through succeeding layers displaced progressively further from bullet resistant outer layer 401, as the compression of swollen hydrogel particles and the presence of free volume results in dissipating frictional flow. Further, flow of exuded free water through respective containing layers as the transmitted shock wave displaces from bullet resistant outer layer 401 continues to attenuate the shock pressure wave.

In the embodiment depicted at FIG. 4, each shock absorbing cell such as shock absorbing cell 409 may be in mechanical communication with one or more other shock absorbing cells, such as shock absorbing cell 410. Mechanical communication between shock absorbing cells such as 409 and 410 aids in attenuation and lateral dispersion of substantially localized pressure waves, which may act more strongly on a given shock absorbing cell due to the spatial relationship between the shock absorbing cell and a point of impact. For example, at FIG. 4, a ballistic impact produces a force F on bullet resistant layer 401 at an impact point, resulting in short duration pressure wave $P_i$ arising as a result of the elastic response of bullet resistant layer 401. As indicated, the short duration pressure wave $P_i$ would be expected to act primarily over a localized area of the plurality of shock absorbing cells, and may have varying magnitude along an axis substantially parallel to back-face 406. The short duration pressure wave $P_i$ would be expected to produce a greater shock pressure on the swollen hydrogel contained in shock absorbing cell 409 than on the swollen hydrogel contained in shock absorbing cell 410, as well as have temporal separation based on time-of-arrival at the respective shock absorbing cells. In such a situation, and given that shock absorbing cells 409 and 410 contain free volumes, mechanical communication between shock absorbing cells 409 and 410 allows expelled free water to be forced through the respective containing layers from, for example, shock absorbing cell 409 to shock absorbing cell 410.

Additionally, in an embodiment such as that depicted at FIG. 4, it may be advantageous to vary the free volume between shock absorbing cells based on the spatial relationship of each shock absorbing cell to back-face 406. For example, shock absorbing cell 409 may have a free volume percentage of approximately 50% when the hydrogel particles contained therein are swollen, while shock absorbing cell 411, which would be expected to experience the effects of short duration pressure wave $P_i$ later-in-time than hydrogel-containing volume 409, may have some free volume percentage greater than that. This may be advantageous in order to ensure that the free volume of shock absorbing cell 411 is sufficient to accommodate both flow of expelled free water from shock absorbing cell 409 and the expulsion of free water from the hydrogel contained within shock absorbing cell 411, once the short duration pressure wave subsequently acts on shock absorbing cell 411. A similar relationship between shock absorbing cells 411 and 412 may be further advantageous, as the free volume contained within shock absorbing cell 412 might be expected to accommodate expelled free water from the hydrogel within shock absorbing cell 412, as well as expelled free water originating in shock absorbing cells 409 and 411, for example. A natural consequence might be one or more closed volumes characterized by an absence of swollen hydrogel particles and comprised of only interior volume, such as, for example, closed volume 416. Such an arrangement, where a plurality of shock absorbing cells comprised of hydrogel particles may be in mechanical communication with closed volumes containing no hydrogel, is contemplated within this disclosure.

An alternate way of expressing the possible free volume variance can be formulated by comparing the geometric centers of two or more shock absorbing cells, such as shock absorbing cells 409 and 411. As depicted at FIG. 4, the geometric center of shock absorbing cell 411 is displaced farther from back-face 406 than the geometric center of shock absorbing cell 409. In order to accommodate the flow of expelled water from shock absorbing cell 409 to shock absorbing cell 411, the free volume percentage of the shock absorbing cell having a greater displacement between the geometric center and back-face 406—here shock absorbing cell 411—would exceed the free volume percentage of the shock absorbing cell having a lesser displacement—here shock absorbing cell 409. Similarly, in an embodiment without a penetration resistant outer layer and a back-face, similar variation of the free volume percentage may be employed based on displacement of geometric centers from a pressure wave receiving face, where the pressure wave receiving face of shock absorbing layer 402 is comprised of those shock absorbing cells expected to directly experience a transmitted shock wave prior to attenuation of the shock wave by other shock absorbing cells. For example, at FIG. 4, and in the absence of penetration resistant outer layer 401, shock absorbing cell 409 would comprise the pressure wave receiving face.

It is understood that in an embodiment such as depicted at FIG. 4, attenuation of the transmitted shock wave occurs as the transmitted shock wave propagates through shock absorbing cells, such as shock absorbing cell 409 and shock absorbing cell 411. Thus, the design shock pressure wave as defined herein may be expected to vary based on the interactions experienced by a transmitted shock wave prior to encountering the hydrogel in a given closed volume. For example, at FIG. 4, the design shock pressure wave of shock absorbing cell volume 411 may be expected to be less than the design shock pressure wave of shock absorbing cell 409. It may be convenient to utilize a single value of design shock pressure wave when evaluating the permeability of a containing layer for sufficiency, however varying values of permeability based on the expected design shock pressure experienced within a given shock absorbing cell are envisioned within this disclosure, and such variations are included within the concept of "sufficient permeability" and like terms as used herein.

Further, at FIG. 4, it is understood that the variance in magnitude of the short duration pressure wave $P_i$ as depicted may be exaggerated relative to the size of shock absorbing cells 409, 410, 411, and 412 for illustrative purposes.

In an embodiment, bullet resistant outer layer 401 is a SiC composite system resistant to a 0.30 caliber AP or under piercing round. The plurality of hydrogel particles comprising each shock absorbing cell are poly(acrylic acid) doped with partial sodium salt with a typical size of less than 150 micron in the unswollen state. The containing layer surrounding each shock absorbing cell is a flexible textile having pore size between ⅛ and 3⁄16 inches. The free volume percentage of each shock absorbing cell is approximately 50%. In this embodiment, a portion of the plurality of shock absorbing cells 402 is in mechanical communication with closed volumes containing no hydrogel, as described above.

It may be further advantageous to incorporate a separating layer into a plurality of shock absorbing cells comprising, for example, a honeycomb structure. The separating layer may have permeability variance from the containing layers enclosing each shock absorbing cell. For example, at FIG. 5, a shock absorbing layer is comprised of a plurality of shock absorbing cells 502 forming a honeycomb structure, and further comprised of separating layer 513. Separating layer 513 is aligned substantially parallel to back-face 506 of bullet resistant outer layer 501. Separating layer 513 is typically a flexible material under, for example, the normal activities of a wearer in a working environment. Further, the separating layer 513 may have a permeability less than the containing layer comprising each shock absorbing cell, such that during the propagation of a design shock pressure wave through the plurality of shock absorbing cells 502, expelled free water experiences increased frictional flow losses when forced through separating layer 513, producing greater energy dissipation. For example, in an embodiment, the containing layer surrounding each shock absorbing cell has a pore size ranging from ⅛" to 3⁄16", while separating layer 513 has a pore size under 1⁄16" diameter. Similar to the acceptable permeability of containing layer 303, it is advantageous to select a permeability of separating layer 513 such that stagnation of expelled free water against separating layer 513 is mitigated in response to a design shock pressure wave.

Figure 5:
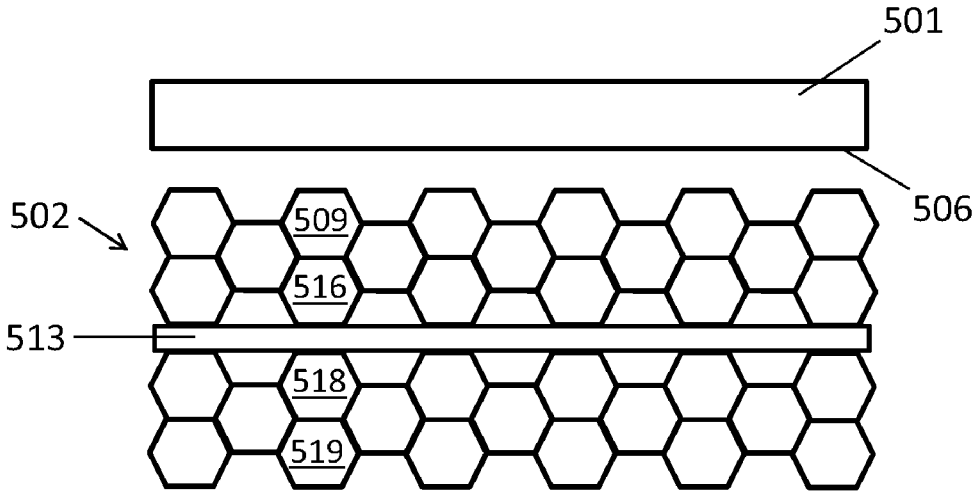
FIG. 5 illustrates a shock absorbing layer comprised of a plurality of shock absorbing cells and a separating layer.
Figure 6:
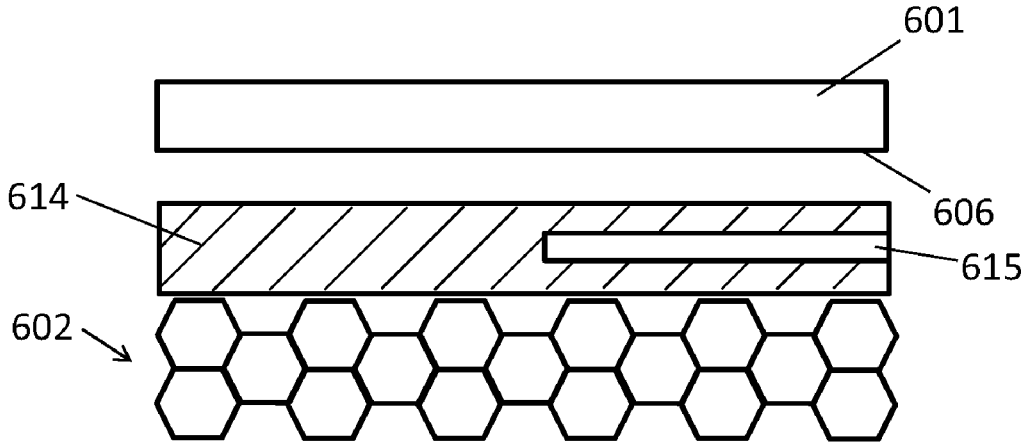
FIG. 6 illustrates a shock absorbing layer comprised of a plurality of shock absorbing cells and a cooling layer.

In the embodiment illustrated at FIG. 5, it may be advantageous to provide mechanical communication between shock absorbing cells and closed volumes at either side of separating layer 513. For example, shock absorbing cells 509 and 518 may be in mechanical communication with closed volumes 516 and 519 respectively. As before, closed volumes 516 and 519 are characterized by an absence of swollen hydrogel particles and comprised of only interior volume In a further embodiment, the shock absorbing layer is comprised of a cooling layer. The cooling layer provides for heat removal from the body of a wearer in operation. Body heat from the wearer may be removed through evaporation of free water within a swollen hydrogel. As illustrated at FIG. 6, the cooling layer 614 lies between strike-face 606 of penetration resistant outer layer 601 and a plurality of shock absorbing cells generally indicated at 602, and lies substantially parallel to back-face 606. Cooling layer 614 has a permeability allowing passage of water vapor, such that water vapor generated from the interaction of body heat and free water in the swollen hydrogel may permeate through cooling layer 614. The cooling layer may be further comprised of cooling channel 615 in fluid communication with an external environment surrounding the shock absorbing layer, to allow more effective passage of heat from cooling layer 614 to the surrounding environment. Further, cooling layer 614 is typically comprised of a flexible material such that normal motion of a wearer causes flexure in cooling layer 614 and deformation of cooling channel 615. Such flexure provides a pumping action within cooling channel 615 and increases the cooling action of cooling layer 614. This may be particularly advantageous for high activity wearers, such as working canines.

It is further understood that various means may be employed in order to establish a spatial relationship between a one or more shock absorbing cells and the back-side of a penetration resistant outer layer as described within this disclosure. Within this disclosure, in embodiments utilizing a penetration resistant outer layer, it is only necessary that the one or more shock absorbing cells be arranged relative to the back-face such that a transmitted shock wave emanating from the back-face impinges on the one or more shock absorbing cells. The shock absorbing cells may take a variety of forms which advantageously provide for ease of use in a working environment. For example, in an armor system comprised of a penetration resistant outer layer, a plurality of shock absorbing cells, and optionally a cooling layer, the penetration resistant outer layer, the plurality of shock absorbing cells, and the cooling layer may be physically separable from one another to provide, for example, for initial or subsequent saturation of the hydrogel particles without immersion of the armor system en toto, or for other operational considerations which may arise.

Thus, the disclosure herein provides a shock absorbing layer for the mitigation of an impinging shock wave from a shock wave source. The shock absorbing layer is comprised of one or more shock absorbing cells individually comprised of a containing layer enclosing a plurality of absorbent hydrogel particles. The cell interior volume formed within the enclosing containing layer is such that when the plurality of hydrogel particles are swollen, the cell interior volume accommodates the hydrogel particles while concurrently allowing for establishment of a free volume devoid of swollen hydrogel particles or other solid or liquid matter. The free volume provides for shock wave dissipation through the compression response of the swollen hydrogel particles. During the compression response, frictional flow of free water exuding from the swollen hydrogel initially dissipates and spreads the energy of the impinging shock wave, and subsequent flow of the exuded free water through the containing layer further mitigates the shock wave energy. In an embodiment, the shock absorbing layer mitigates transmitted shock waves emanating from the back-face of a penetration resistant material. The shock absorbing layer may include a cooling layer to provide, for example, comfort to the wearer of a personal armor system incorporating the shock absorbing layer.

Accordingly, the disclosure provides a shock absorbing layer utilizing a swollen hydrogel in a manner that more effectively mitigates shock wave compression energy, so that the coupling of a shock wave compression to the body of the wearer is further reduced.

Further, the disclosure provides a shock absorbing layer utilizing a swollen hydrogel in a manner allowing absorption of shock pressures through frictional flow between free water and the hydrogel network.

Further, the disclosure provides a shock absorbing layer utilizing a swollen hydrogel in a manner that provides for additional energy absorption through subsequent frictional flow of free water exuded as a result of shock pressure.

Further, the disclosure provides a shock absorbing layer incorporating a plurality of contained hydrogel volumes, so that exuded free water may act to disperse shock pressure energy in directions substantially dissimilar to the prevailing shock pressure wave.

Further, the disclosure provides a shock absorbing layer incorporating a plurality of contained hydrogel volumes in mechanical communication and having increasing free volume percentages as displacement from the shock pressure source increases, in order to accommodate flow of exuded free water and increase frictional flow losses.

Further, the disclosure provides a shock absorbing layer incorporating a flexible cooling layer comprised of one or more cooling channels in fluid communication with an ambient environment, so that cooling may be provided to a wearer in a high temperature environment It is to be understood that the above-described arrangements are only illustrative of the application of the principles of the present disclosure and it is not intended to be exhaustive or limit the invention to the precise form disclosed. Numerous modifications and alternative arrangements may be devised by those skilled in the art in light of the above teachings without departing from the spirit and scope of the present disclosure. It is intended that the scope of the disclosure be defined by the claims appended hereto.

In addition, the previously described versions of the present disclosure have many advantages, including but not limited to those described above. However, the disclosure does not require that all advantages and aspects be incorporated into every embodiment of the present disclosure.

All publications and patent documents cited in this application are incorporated by reference in their entirety for all purposes to the same extent as if each individual publication or patent document were so individually denoted.

What is claimed is:

1. A shock absorbing layer comprised of:

a plurality of shock absorbing cells, where each shock absorbing cell in the plurality of shock absorbing cells is in mechanical communication with at least one other shock absorbing cell in the plurality of shock absorbing cells, and where the each shock absorbing cell in the plurality of shock absorbing cells is comprised of, a cell interior volume, a plurality of hydrogel particles contained within the cell interior volume, where the cell interior volume exceeds the volume of the plurality of hydrogel particles when the plurality of hydrogel particles are swollen, such that a free volume exists within the cell interior volume when the plurality of hydrogel particles are swollen and, a containing layer having a permeability and surrounding the cell interior volume, where the permeability is such that at least a portion of the plurality of hydrogel particles are contained within the cell interior volume when the plurality of hydrogel particles are swollen and subjected to a design shock pressure wave, and where the permeability is such that when a volume of water is adjacent to the containing layer and the volume of water is subjected to the design shock pressure wave, at least some portion of the volume of water flows through the containing layer; and a penetration resistant outer layer having a strike-face and a back-face, where the back-face is between the plurality of shock absorbing cells and the strike-face.

2. The shock absorbing layer of claim 1 where the each shock absorbing cell has a free volume percentage of at least 20%.

3. The shock absorbing layer of claim 2 where a first shock absorbing cell in the plurality of shock absorbing cells has a first geometric center and a first free volume percentage and a second shock absorbing cell in the plurality of shock absorbing cells has a second geometric center and a second free volume percentage, and where the displacement of the second geometric center from the back-face of the penetration resistant outer layer is greater than the displacement of the first geometric center from the back-face of the penetration resistant outer layer, and where the first free volume percentage is less than the second free volume percentage.

4. The shock absorbing layer of claim 1 where a first portion of the plurality of shock absorbing cells is separated from a second portion of the plurality of shock absorbing cells by a separation layer aligned substantially parallel to the back-face of the penetration resistant outer layer, where the separating layer is permeable to water.

5. The shock absorbing layer of claim 4 where the separating layer has a permeability less than the permeability of the containing layer.

6. The shock absorbing layer of claim 5 where a first shock absorbing cell in the first portion of the plurality of shock absorbing cells has a first geometric center and a first free volume percentage and a second shock absorbing cell in the first portion of the plurality of shock absorbing cells has a second geometric center and a second free volume percentage, and where the displacement of the second geometric center from the back-face of the penetration resistant outer layer is greater than the displacement of the first geometric center from the back-face of the penetration resistant outer layer, and where the first free volume percentage is less than the second free volume percentage, and further comprised of a plurality of closed volumes, where the plurality of closed volumes is between the separation layer and the first portion of the plurality of shock absorbing cells, and where each dosed volume in the plurality of closed volumes is comprised of an interior volume and an enclosing layer surrounding the each closed volume, and where the each closed volume is further characterized by an absence of hydrogel particles, and where the enclosing layer has a permeability such that when a water mass is separated from the each closed volume by the enclosing layer and subjected to the design shock pressure wave, at least some portion of the water mass flows through the enclosing layer into the each closed volume.

7. The shock absorbing layer of claim 1 further comprised of a plurality of closed volumes, where the back-face of the penetration resistant outer layer is between the plurality of closed volumes and the strike-face of the penetration resistant outer layer, where each closed volume in the plurality of closed volumes is comprised of an interior volume and an enclosing layer surrounding the each closed volume, and where the each closed volume is further characterized by an absence of hydrogel particles, and where the enclosing layer has a permeability such that when a water mass is separated from the each closed volume by the enclosing layer and subjected to the design shock pressure wave, at least some portion of the water mass flows through the enclosing layer into the each closed volume.

8. The shock absorbing layer of claim 1 further comprising a cooling layer between the back-face and the plurality of shock absorbing cells, where the cooling layer has a permeability allowing passage of water vapor through the cooling layer.

9. The shock absorbing layer of claim 8 where the cooling layer is further comprised of at least one cooling channel, where the at least one cooling channel is in fluid communication with an external environment surrounding the shock absorbing layer.

10. The shock absorbing layer of claim 9 where the cooling layer is further comprised of an elastically deforming material, such that subjecting the cooling layer to repeated cycles of compression and relaxation deforms the at least one cooling channel.

11. The shock absorbing layer of claim 1 where the hydrogel is a lightly cross-linked hydrogel.

12. The shock absorbing layer of claim 1 where the containing layer of the each shock absorbing cell has an average pore size of from about ⅛ inches to about 3/16 inches.

13. An article of protective armor, comprising:

a penetration resistant outer layer having a strike-face and a back-face; and a shock absorbing inner layer arranged such that the back-face of the penetration resistant outer layer is between the shock absorbing inner layer and the strike-face of the penetration resistant outer layer, where the shock absorbing inner layer is comprised of a plurality of shock absorbing cells, where each shock absorbing cell in the plurality of shock absorbing cells is in mechanical communication with at least one other shock absorbing cell in the plurality of shock absorbing cells, and where the each shock absorbing cell in the plurality of shock absorbing cells is comprised of, a cell interior volume, a plurality of hydrogel particles contained within the cell interior volume, where the cell interior volume exceeds the volume of the plurality of hydrogel particles when the plurality of hydrogel particles are swollen, such that a free volume exists within the cell interior volume when the plurality of hydrogel particles are swollen, and such that the free volume percentage is at least 20% and, a containing layer having a permeability and surrounding the cell interior volume, where the permeability is such that at least a portion of the plurality of hydrogel particles are contained within the cell interior volume when the plurality of hydrogel particles are swollen and subjected to a design shock pressure wave, and where the permeability is such that when a volume of water is adjacent to the containing layer and the volume of water is subjected to the design shock pressure wave, at least some portion of the volume of water flows through the containing layer.

14. The protective armor of claim 13 where a first shock absorbing cell in the plurality of shock absorbing cells has a first geometric center and a first free volume percentage and a second shock absorbing cell in the plurality of shock absorbing cells has a second geometric center and a second free volume percentage, and where the displacement of the second geometric center from the back-face is greater than the displacement of the first geometric center from the back-face, and where the first free volume percentage is less than the second free volume percentage.

15. The protective armor of claim 14 further comprised of a plurality of closed volumes, where the back-face of the penetration resistant outer layer is between the plurality of closed volumes and the strike-face of the penetration resistant outer layer, where each closed volume is comprised of an interior volume and an enclosing layer surrounding the each dosed volume, and where the each closed volume is further characterized by an absence of hydrogel particles, and where the enclosing layer has a permeability such that when a water mass is separated from the each closed volume by the enclosing layer and subjected to the design shock pressure wave, at least some portion of the water mass flows through the enclosing layer into the each closed volume.

16. The protective armor of claim 14 where a first portion of the plurality of shock absorbing cells is separated from a second portion of the plurality of shock absorbing cells by a separation layer aligned substantially parallel to the back-face of the penetration resistant outer layer, where the separating layer is permeable to water, and where the separating layer has a permeability less than the permeability of the containing layer.

17. The protective armor of claim 13 further comprising a cooling layer between the penetration resistant outer layer and the shock absorbing inner layer, where the cooling layer has a permeability allowing passage of water vapor through the cooling layer.

18. The protective armor of claim 17 where the cooling layer is further comprised of at least one cooling channel, where the at least one cooling channel is in fluid communication with an external environment surrounding the protective armor, and where the cooling layer is further comprised of an elastically deforming material, such that subjecting the cooling layer to repeated cycles of compression and relaxation deforms the at least one cooling channel.

19. The protective armor of claim 12 where the hydrogel is a lightly cross-linked hydrogel.

20. An article of protective armor, comprising:

a penetration resistant outer layer having a strike-face and a back-face;

a shock absorbing inner layer arranged such that the back-face of the penetration resistant outer layer is between the shock absorbing inner layer and the strike-face of the penetration resistant outer layer, where the shock absorbing inner layer is comprised of a plurality of shock absorbing cells, where each shock absorbing cell in the plurality of shock absorbing cells is in mechanical communication with at least one other shock absorbing cell in the plurality of shock absorbing cells, and where a first shock absorbing cell in the plurality of shock absorbing cells has a first geometric center and a second shock absorbing cell in the plurality of shock absorbing cells has a second geometric center, where the displacement of the second geometric center from the back-face is greater than the displacement of the first geometric center from the back-face, and where each shock absorbing cell in the plurality of shock absorbing cells is comprised of, a cell interior volume, a plurality of hydrogel particles comprised of a lightly cross-linked hydrogel and contained within the cell interior volume, where the cell interior volume exceeds the volume of the plurality of hydrogel particles when the plurality of hydrogel particles are swollen, such that a free volume exists within the cell interior volume when the plurality of hydrogel particles are swollen, and such that the free volume percentage is at least 20%, and such that the first shock absorbing cell in the plurality of shock absorbing cells has a first free volume percentage and the second shock absorbing cell in the plurality of shock absorbing cells has a second free volume percentage, where the first free volume percentage is less than the second free volume percentage and, a containing layer having a permeability and surrounding the cell interior volume, where the permeability is such that at least a portion of the plurality of hydrogel particles are contained within the cell interior volume when the plurality of hydrogel particles are swollen and subjected to a design shock pressure wave, and where the permeability is such that when a volume of water is adjacent to the containing layer and the volume of water is subjected to the design shock pressure wave, at least some portion of the volume of water flows through the containing layer;

a separation layer aligned substantially parallel to the back-face, where the separation layer separates a first portion of the plurality of closed volumes from a second portion of the plurality of closed volumes, and where the separating layer is permeable to water, and where the separating layer has a permeability less than the permeability of the containing layer; and a cooling layer between the penetration resistant outer layer and the shock absorbing inner layer, where the cooling layer has a permeability allowing passage of water vapor through the cooling layer, and where the cooling layer is further comprised of at least one cooling channel, where the at least one cooling channel is in fluid communication with an external environment surrounding the protective armor, and where the cooling layer is further comprised of an elastically deforming material, such that subjecting the cooling layer to repeated cycles of compression and relaxation deforms the at least one cooling channel.

* * * * *